United States Patent [19]

Ito

[11] Patent Number: 4,477,196

[45] Date of Patent: Oct. 16, 1984

[54] ANALOG ELECTRONIC TIMEPIECE

[75] Inventor: Jiro Ito, Suwa, Japan

[73] Assignee: Kabushiki Kaisha Suwa Seikosha, Tokyo, Japan

[21] Appl. No.: 375,649

[22] Filed: May 6, 1982

[30] Foreign Application Priority Data

May 7, 1981 [JP] Japan ..... 56-68825
Feb. 8, 1982 [JP] Japan ..... 57-18644

[51] Int. Cl.[3] ..... G04F 5/00; G04B 19/00
[52] U.S. Cl. ..... 368/157; 368/76
[58] Field of Search ..... 368/76, 80, 85, 86, 368/155–157, 160, 217–219; 318/696

[56] References Cited

U.S. PATENT DOCUMENTS 4,048,548 9/1977 Nakajima et al. ..... 318/696 X
4,055,785 10/1977 Nakajima et al. ..... 318/696 X
4,312,059 1/1982 Mandai et al. ..... 368/157
4,368,990 1/1983 Ueda et al. ..... 368/157

*Primary Examiner*—Vit W. Miska
*Attorney, Agent, or Firm*—Blum, Kaplan, Friedman, Silberman & Beran

[57] ABSTRACT

A stepper rotor is driven with a narrow pulse width input which matches the load conditions on the motor. The subsequent position of the rotor is detected as being rotated or non-rotated by application of a detection pulse to the rotor. An additional driving pulse of increased width is applied should the rotor be found in a non-rotated state. A stabilizing pulse prevents intermediate rotor positioning. Position of the stepper motor is detected by passing a current through the rotor cell. The rate of increase in detection current is different when the rotor has rotated and when the rotor does not rotate because coil inductance and magnetic flux directions passing through the saturable portion of the stator are different depending upon the position of the rotor. The width of the driving pulse for normal operation is selected from a range of pulse widths so as to match the load on the motor.

17 Claims, 23 Drawing Figures

FIG. 1
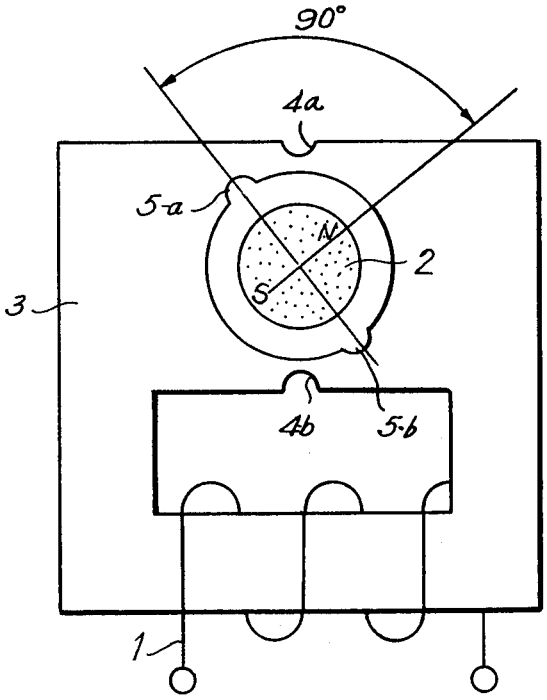
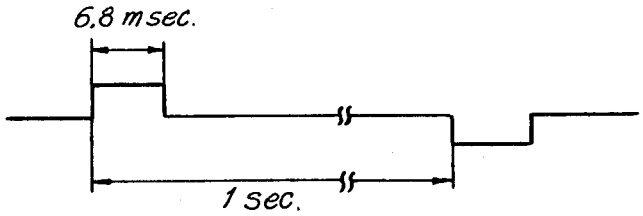
FIG. 2

FIG. 3
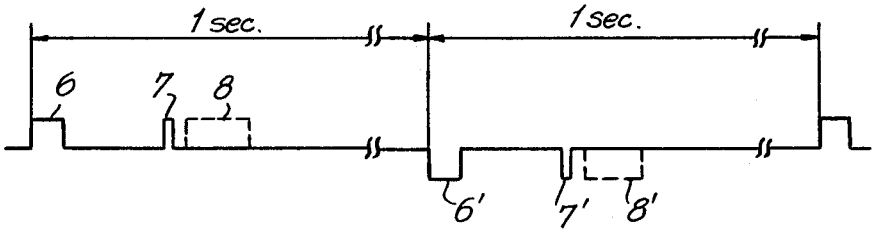
FIG. 4
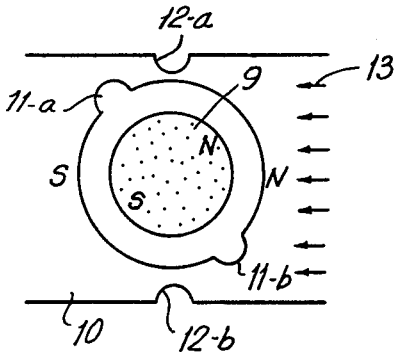
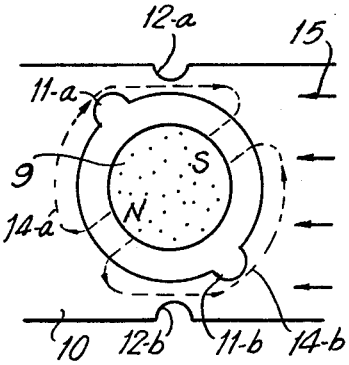
FIG. 5a
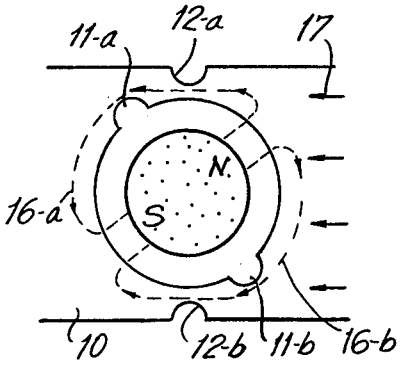
FIG. 5b

FIG.6
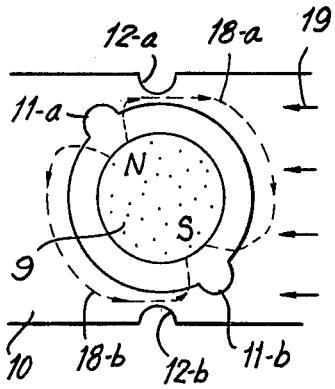
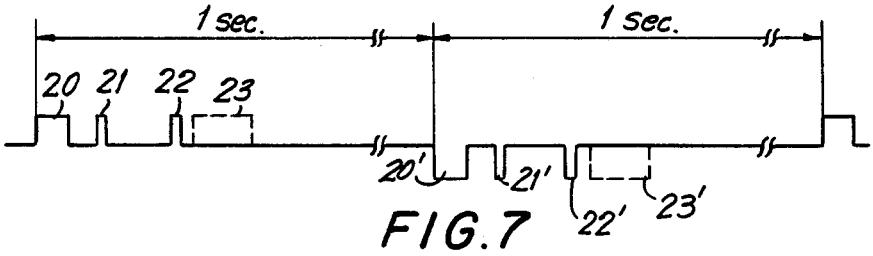
FIG.7
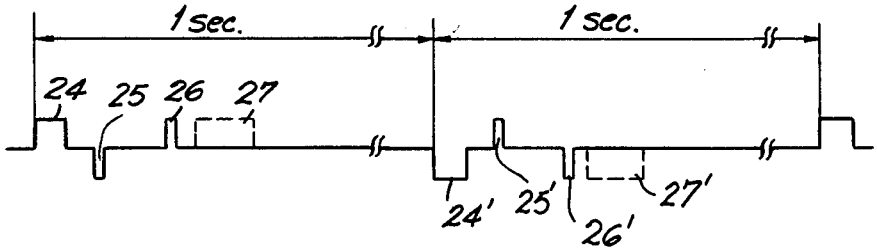
FIG.8

FIG. 9
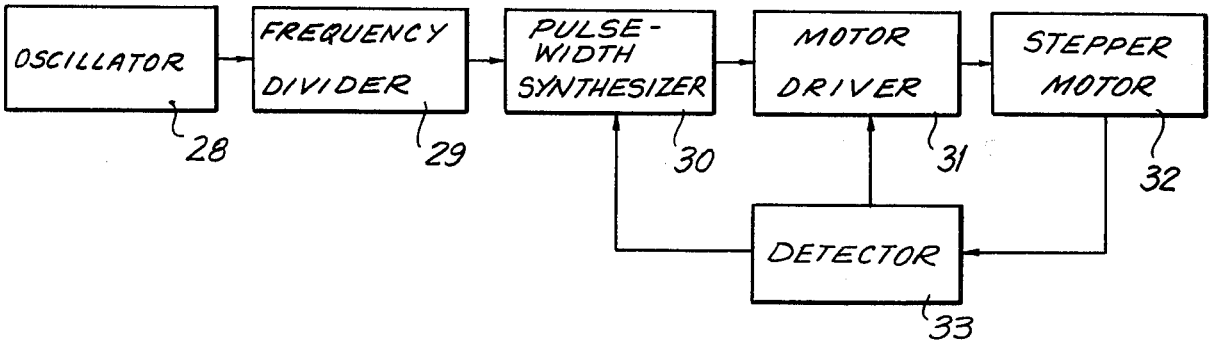
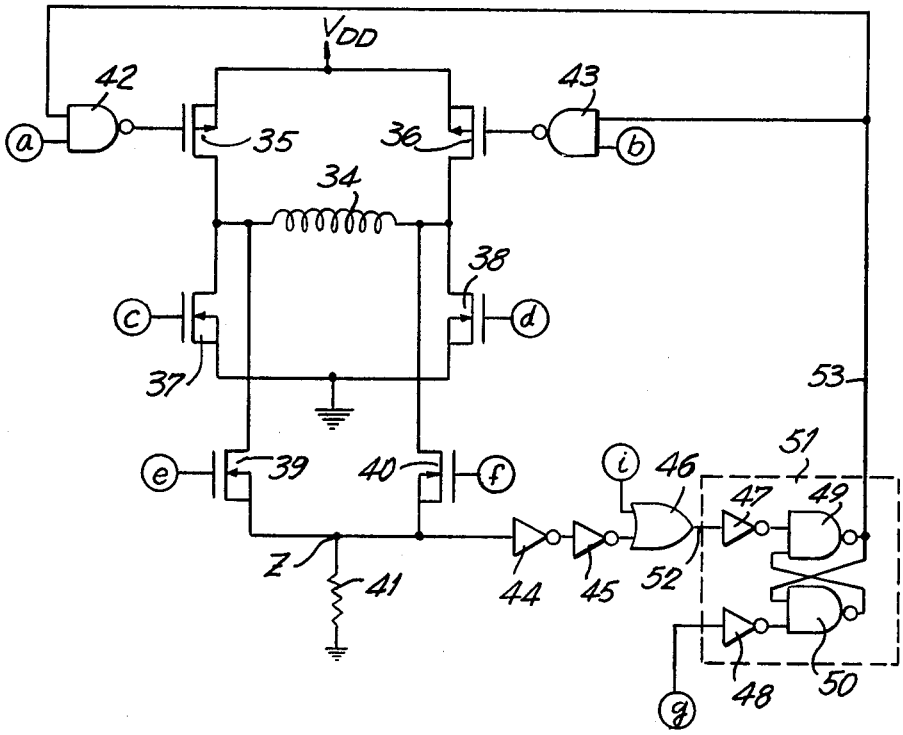
FIG. 10

FIG. 12
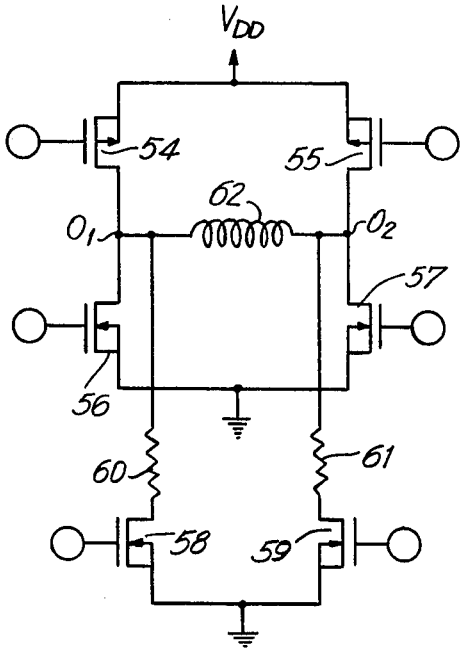
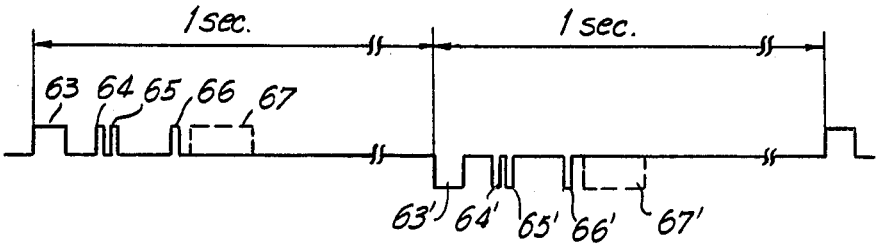
FIG. 13

ANALOG ELECTRONIC TIMEPIECE

BACKGROUND OF THE INVENTION

This invention relates generally to an analog electronic timepiece of the type having hands including a second hand and more particularly to a timepiece which efficiently utilizes the energy stored in the power supply battery to drive the hands. Analog timepieces are generally driven by a stepper motor which connects to the hands through a gear train. The motor is driven electrically by application of voltage pulses having sufficient width to assure that the gear train drives the second hand at the rate of one second per second. The load on the stepper motor varies for many reasons, for examples, as the timepiece becomes older friction increases. At lower temperatures viscosity of the lubricating oil increases, and additional functions such as a date dial may require advancement, adding a load on the motor. In the prior art the driving pulse applied to the stepper motor is sufficiently long in duration so that the worst of these conditions is adequately met and the second hand advances reliably. This is wasteful in that under more favorable conditions, a shorter pulse width and less electrical energy, are required to advance the gear train and hands. Nevertheless, a margin of safety is maintained in the driving pulse width to assure proper hand advancement and power is wasted.

What is needed is an analog electronic timepiece which normally operates on a narrower width driving pulse, yet provides automatic corrective measures whenever the original pulse is inadequate to properly advance the hands.

SUMMARY OF THE INVENTION

Generally speaking, in accordance with the invention, an analog electronic timepiece especially adapted to save motor energy while assuring timekeeping accuracy is provided. A stepper rotor is driven with a narrow pulse width input which matches the load conditions on the motor. The subsequent position of the rotor is detected as being rotated or non-rotated by application of a detection pulse to the rotor. An additional driving pulse of increased width is applied should the rotor be found in a non-rotated state. A stabilizing pulse prevents intermediate rotor positioning. Position of the stepper motor is detected by passing a current through the rotor coil. The rate of increase in detection current is different when the rotor has rotated and when the rotor does not rotate because coil inductance and magnetic flux directions passing through the saturable portion of the stator are different depending upon the position of the rotor. Very little energy is consumed in providing detection and stabilizing pulses in comparison with normal driving of the stepper motor with a narrower pulse width signal. The width of the driving pulse for normal operation is selected from a range of pulse widths so as to match the load on the motor.

Accordingly, it is an object of this invention to provide an improved electronic analog timepiece which conserves energy by driving the stepper motor with a narrow pulse width adapted to match the motor load.

Another object of this invention is to provide an improved electronic analog timepiece which detects whether a stepper motor driven with a narrow pulse width has, in fact, been properly rotated.

A further object of this invention is to provide an improved electronic analog timepiece which detects rotation or non-rotation of the stepper motor, when driven, and provides a supplemental driving pulse to correct a non-rotated condition.

Still another object of this invention is to provide an improved electronic analog timepiece which corrects for any intermediate stops of the rotor of a stepper motor when said motor is driven.

Yet another object of this invention is to provide an improved electronic analog timepiece having high timekeeping accuracy and low power consumption.

The invention accordingly comprises the features of construction, combination of elements, arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 1 is a semi-schematic view to an enlarged scale of a stepper motor for an analog electronic timepiece in accordance with the invention;

FIG. 2 is a conventional voltage waveform for driving the stepper motor of FIG. 1;

FIG. 3 is a voltage waveform including a correction pulse for driving a stepper motor of FIG. 1;

FIGS. 4, 5*a*, 5*b* and 6 are partial views similar to FIG. 1 showing magnetic flux patterns during operation of the motor of FIG. 1;

FIG. 7 is a voltage waveform for driving the stepper motor of FIG. 1 in accordance with the invention;

FIG. 8 is an alternative waveform in accordance with the invention for driving the stepper motor of FIG. 1;

FIG. 9 is a functional block diagram of an analog electronic timepiece operated in accordance with the invention;

FIG. 10 is a circuit for a motor driver and detector for the circuit of FIG. 9;

FIG. 12 is an alternative circuit in accordance with the invention;

FIG. 13 is a signal waveform for driving a stepper motor of FIG. 1 in accordance with an alternative embodiment of the invention;

DESCRIPTION OF THE PREFERRED EMBODIMENTS

Figure 11:
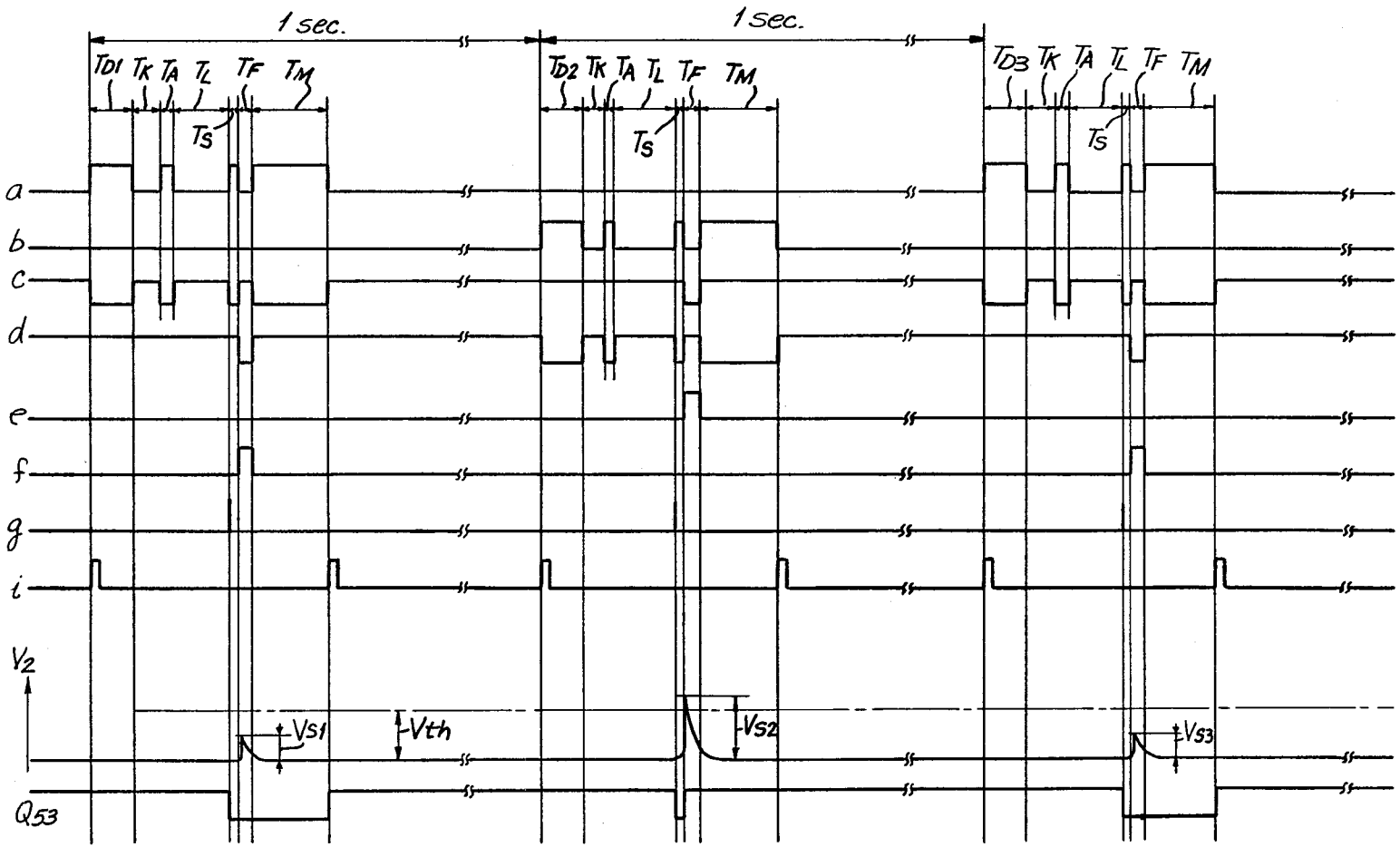
FIG. 11 is signal waveforms at various points in the circuit of FIG. 10.

FIG. 1 shows a stepper motor for an analog electronic timepiece which has been in general use and is also used in the analog electronic timepiece in accordance with the invention. The stepper motor of FIG. 1 comprises a coil 1, rotor 2 magnetized with two polarities, and a stator 3, the stator having inward notches 5a, 5b, and outside notches 4a, 4b. When the coil 1 is not energized, the rotor 2 is at rest at a position in which a line passing through the poles of the rotor extends substantially at a right angle to a line passing through the inward notches 5a, 5b. The coil 1 is inputted with electrical pulses of opposite polarities applied alternately, conventionally every second. Thereby, the rotor 2 is angularly moved through an increment of 180 degrees to drive an array of wheels (not shown).

Each drive pulse has a constant pulse width of 6.8 milliseconds (FIG. 2) regardless of the load conditions and motor output conditions. The width of the drive pulse is selected so as to provide a sufficient safety margin for enabling the step motor to be properly driven even when subjected to a large load as when driving a calendar mechanism in an electronic timepiece.

Such a pulse width is considerably wasteful of electrical current and power especially when the stepper motor is under a normal load which is low. Since the power supply voltage drops at low temperatures because the internal resistance of the battery increases, the width of the motor drive pulse is determined so as to enable the step motor to produce a sufficiently large output torque to provide against the reduction in motor output torque which is caused by a voltage drop in the power supply, for example, as stated, at low temperatures. This practice also results in wasteful current consumption when the stepper motor operates at ordinary temperatures.

A similar precautionary measure needs to be taken against increased friction to rotation of the stepper motor. Friction increases with time. Therefore, there is required a greater current consumption than is needed to maintain the stepper motor in normal rotation with a high degree of reliability. This excessive current consumption, provided as a contingency against unfavorable load conditions, is a major obstacle to the reduction of energy consumption in an analog electronic timepiece.

To eliminate the above described problems, a system has been proposed in which a stepper motor is driven with pulses having a narrower pulse width than is conventional under normal operating conditions. Upon rotation of the stepper motor, the motor is provided with further pulses having a width equal to or shorter than the width of the previous pulses. Thereby, the stepper motor is driven by pulses having optimum widths for the load conditions and output torque conditions.

The most important step in driving the stepper motor with optimum pulse width is to determine whether the rotor has rotated or not. In order to determine whether or not the rotor has been rotated by an applied pulse, it has been proposed to electrically detect the position of the rotor. In this technique, a detector pulse 7 (FIG. 3) is applied in order to determine the rotor position when the rotor is stopped after transient vibrations of the rotor due to an applied pulse 6, are over, as shown in FIG. 3. When the rotor is not found in the desired position, a correction pulse 8 is applied to move the rotor and maintain hand movement at the normal rate. If the rotor is in the desired position than the correction pulse 8 is omitted.

The process of determining the rotor position is now described in greater detail. With the rotor in the position as shown in FIG. 4, a magnetic flux 13 is generated as indicated by the arrows 13 when the coil is energized by an applied drive pulse. If the drive pulse is sufficiently long at this time, the motor moves angularly through 180 degrees to the position shown in FIG. 5a, that is, the poles are initially repelled causing the rotor to turn.

When a detection pulse is then applied to verify the angular position of the rotor as it is located (FIG. 5a), the magnetic flux 15 generated by the detection pulse passes in a direction which cancels out the magnetic flux 14a, 14b produced by the rotor magnetic poles in the vicinity of the outside notches 12a, 12b. Thus, magnetic resistance is small and the coil inductance is large. Current due to the detection pulse increases gradually.

Conversely, when the width of a drive pulse is too small to drive the rotor, the rotor remains in the position of FIG. 5b which is the same as the position of FIG. 4. At this time, magnetic flux generated by the rotor magnet passes in a direction opposite to that shown in FIG. 5a in the vicinity of the outward notches 12a, 12b. Therefore, these magnetic flux lines are added to the magnetic flux 17 due to the detection pulse, resulting in a larger magnetic resistance and a small coil inductance. Current flowing due to the detection pulse increases sharply. By finding the difference between the rates of increase of such detection currents, the angular position of the rotor is determined and it is also determined whether the rotor is rotated or not from the position shown in FIG. 4.

It is well known that a pulse width control system serves to supply pulses having the minimum width required to rotate the rotor. Therefore, a rotor after a drive pulse has been applied thereto may assume the position shown in FIG. 6, rather than one of the positions of FIG. 5a and 5b. In the position of FIG. 6, the central positions of the magnetic poles of the rotor are located at a neutral point. That is, the poles are aligned with a line passing through the inner notches 11a, 11b. This phenomenon is hereinafter referred to as an intermediate stop. This neutral position is unstable. Hence, the rotor is likely to move into either stabilized position (5a, 5b) immediately under the influence of mechanical vibration, magnetic disturbance, or the like. Without such a disturbance, however, the rotor tends to remain in the neutral position.

When a detection pulse is applied while the rotor is in the neutral position, magnetic flux lines 18a, 18b generated by the rotor magnet pass in a direction opposite to the magnetic flux 19 generated by the detection pulse in the vicinity of the outer notches 12a, 12b. This condition is magnetically similar to that in which the rotor is angularly moved as shown in FIG. 5a. Thus, current due to the detection pulse increases gradually as when the rotor is angularly moved, with the result that the rotor is detected as having been angularly moved while, in fact, it has not rotated. With the rotor sensed as being angularly moved, no correction pulse is applied and the next drive pulse with an opposite polarity is applied one section thereafter. This next drive pulse causes the rotor to return to the starting position. The watch has then lost two seconds as a total loss since no complete motions of the rotor have been achieved.

The fact that the display time is lagging behind the actual time is a serious defect in quartz crystal timepieces which are vaunted for their greater accuracy. The greater is the number of pulses which are controlled in width, the higher is the probability of occurrence of such an intermediate stop of the rotor, and the greater is the possibility for the hands to lag in operation. These unfavorable tendencies become more pronounced with time as the array of wheels operates under a heavier load and as the ambient temperature becomes lower whereby viscosity of the lubricant used in the mechanism is increased.

The analog electronic timepiece in accordance with the invention is constructed in an effort to overcome the difficulties described above and to render the stepper motor less consuming of electric power through sensing of rotation or non-rotation of the rotor of the step motor. At the same time, the absolute reliability required in the movement of the hands is maintained. More specifically, a stabilizing pulse is applied to bring the rotor position into a stationary stabilized condition after a drive pulse has been applied, thereby assuring absolutely reliable detection. The invention is now described in detail with reference to the drawing.

FIG. 7 illustrates waveforms of pulses applied to a coil of an analog electronic timepiece in accordance with the invention. A drive pulse 20 is selected from several pulses with different widths such that the selected width is optimum for the condition in which the array of wheels is loaded and for the output torque condition of the motor. Assuming that the rotor of the step motor is angularly positioned as shown in FIG. 4, the rotor tends to rotate counterclockwise under the influence of the magnetic flux 13 generated by the drive pulse 20. When the output torque of the motor due to the drive pulse is sufficiently large, the rotor rotates to the position as shown in FIG. 5*a*. When the motor torque is insufficient, the rotor can remain positioned as illustrated in FIG. 5*b*, that is, unmoved as compared to FIG. 4. However, the rotor may undergo an intermediate stop, as described, that is, stop in a neutral position with the centers of the magnetic poles of the rotor being on a line passing through the inward notches 11*a*, 11*b* as shown in FIG. 6. Namely, the rotor is in a position other than the positions of FIG. 5*a* and 5*b*. As described, such operation causes the watch to lose even-numbered seconds, that is, two seconds for each malfunction.

In the analog electronic timepiece in accordance with the invention, a magnetic disturbance is caused by a pulse 21, hereinafter referred to as a stabilizing pulse, after the pulse 20 has been applied (FIG. 7). The stabilizing pulse 21 enables the rotor to fall into either one of the stationary stabilized positions (FIGS. 5*a* or *b*) even if the rotor is subjected to an intermediate stop. A state with the rotor in the intermediate stop position as shown in FIG. 6 is quite unstable, and the rotor has a tendency to shift from such an intermediate stop position to either side any time the rotor is given an opportunity to move. Therefore, the rotor falls from the intermediate stop position to a stationary stable position in response to application of a stabilizing pulse 21 having a narrow pulse width.

A detection pulse 22 is applied after the stabilizing pulse 21 has been applied as illustrated in FIG. 7. At this time, the rotor is not in an intermediate stop position but is assuredly in the position of either FIG. 5*a* or 5*b*. Thus, the reliability of position detection is absolute. When it is determined that the rotor has not been rotated, a correction pulse 23, indicated by the broken line in FIG. 7, is generated to insure normal hand movement.

Although the stabilizing pulse 21 is applied in the same direction as that of the drive pulse 20 (FIG. 7), a stabilizing pulse 25 may be applied in a polarity opposite to that of a drive pulse 24 as shown in FIG. 8. In this alternative operation in accordance with the invention, determination of rotor position using a detection pulse 26 is rendered somewhat unstable due to the influence of magnetic hysteresis resulting from residual magnetic fluxes produced by the stabilizing pulse 25. Additionally, the rotor which has been subjected to an intermediate stop tends in most cases to fall into a non-rotated position when a reverse polarity stabilizing pulse 25 is applied, with the result that it is highly likely that a correction pulse 27 will be necessary for application. Such operation is unfavorable from the viewpoint of reducing current consumption.

For the reasons described above, the stabilizing pulse should preferably be applied in the same direction, that is, with the same polarity, as that of the drive pulse as shown in FIG. 7 for assuring accurate rotor position detection using the detection pulse. With the stabilizing pulse being applied in this manner, the rotor, after it has come to an intermediate stop, is most likely to fall into the rotated position due to the stabilizing pulse. Accordingly, there is less tendency for a correction pulse to be needed and applied, which results in less power consumption.

Application of a stabilizing pulse incurs an increased current consumption. However, the width of such a stabilizing pulse may be very small since, as stated, the rotor when it is brought to an intermediate stop is quite unstably positioned and is prone to fall into a stationary stabilized position anytime the rotor is given an opportunity to move, even with a very narrow pulse. Thus, there is little danger that the current consumed by the stabilizing pulse will adversely affect the overall current consumption by the step motor.

A particular circuit for an analog electronic timepiece in accordance with the invention, is now described with reference to the block diagram of FIG. 9. The circuit comprises an oscillator 28, frequency divider 29, pulse width synthesizer 30, motor driver 31, stepper motor 32 and detector 33. The oscillator 28, frequency divider 29 and pulse width synthesizer 30 are indispensible components of the analog electronic timepiece in accordance with the invention. Nevertheless, they are readily constructed by one skilled in the art using logic elements, and thus, are not described in detail herein.

FIG. 10 illustrates in greater detail the motor driver 31 and detector 33 in accordance with the invention. The circuit includes P-channel transistors 35, 36, N-channel transistors 37, 38 and NAND gates 42, 43 which are connected respectively to the gate terminals of the P-channel transistors 35, 36. These components in combination constitute the motor driver 31. N-channel transistors 39, 40 have drains connected to both ends of a coil 34 and sources grounded through a resistor 41. The resistor 41 has one end Z connected to a detecting element comprising an inverter 44. An output from the detecting element 44 is shaped by an inverter 45 and is inputted by way of an OR gate 46 to the set terminal 52 of a flip-flop 51. The flip-flop 51 has an output 53 connected to the NAND gates 42, 43. The above components in combination constitute the detector 33.

FIG. 11 illustrates signal waveforms to be applied to input terminals a–g and i indicated in FIG. 10. In FIG. 11, the widths of pulses for driving the stepper motor are designated as TD1, TD2, and TD3. These pulse widths are available in a wide range, such as, for examples, 2.44, 2.93, 3.17, 3.42, 3.66 milliseconds. From this assortment of available pulse widths, a pulse which is considered optimum for the conditions of the timepiece is selected and applied. The width of the stabilizing pulse is indicated as TA which is an important feature of the present invention. An interval of time TL allows transient vibrations of the rotor driven by the drive and stabilizing pulses to subside, that is, vibrations are eliminated. The width of a detection pulse is indicated as TS and this width is selected to determine the rotor position. As an example, the pulse, width TS is 0.24 milliseconds.

The current generated by the detection pulse is detected in the interval TF. A correction drive pulse which is applied when the rotor is sensed as being non-rotated, has a width TM which is relatively large, for example, the pulse width TM may be 6.8 milliseconds. VZ is the potential at the point Z of FIG. 10, and Q53 is a signal shown in FIG. 10 at the output terminal of the flip-flop 51.

Operation of the circuit of FIG. 10 is now described with reference to the timing chart of FIG. 11. During the interval TD1 the P-channel transistor 35 and the N-channel transistor 38 are turned on to energize the motor coil 34. These components operate in the same way when a subsequent stabilizing pulse having the width TA is applied. The stabilizing pulse TA causes the rotor to be moved out of an intermediate stop position, if in such a position, into either one of two stationary stable positions. After a time interval TL following the applied stabilizing pulse TA, the rotor has finished its transient vibrations and stops in either of the stationary stabilized positions.

Assuming that the rotor has been rotated, when a current flows within the coil 34 due to the applied detection pulse, having the width TS, the coil inductance is large and current increases gradually as the detection pulse TS is applied in a direction to attract the rotor. During the interval TF, while current is increasing, the transistor 35, 38 are turned off, and the N-channel transistors 37, 40 are energized. Thereupon, the current flows abruptly through the resistor 41 generating a transient-peak voltage at the point Z. Because the current has risen only slightly, a maximum value Vs1 of the potential VZ at the point Z does not exceed a threshold voltage Vth of the detecting element 44. Therefore, the detecting element 44 produces an output which is high (H) in logic level and the input terminal 52 of the flip-flop 51 remains low. As the reset terminal of the flip-flop 51 has already been reset by a reset signal g, the output Q53 remains low. The correction pulse TM is blocked by the NAND gate 42 outputting to the gate of the P-channel transistor 35, and is not applied.

During the interval TD2 one second thereafter, the P-channel transistor 36 and the N-channel transistor 37 are turned on by the signal b to energize the coil 34 in the opposite direction during the period represented by the pulse TD2. Assume that the rotor does not rotate for some reason. The rotor is held completely stationary during the time period TL after the stabilizing pulse TA has been applied. When a detection pulse having the width TS is now applied, current increases sharply because of a reduced coil inductance. When the transistor 36, 37 are turned off and the N-channel transistors 38, 39 are turned on, a voltage peak Vs2 (FIG. 11) is produced. Because the voltage Vst is larger than the threshold potential Vth of the detecting element 44, the detecting element 44 generates a low output. Thus, the set terminal 52 of the flip-flop 51 goes high and the output 53 of the flip-flop 51 goes high. This high condition allows the correction pulse TM to be delivered through the NAND gate 43. The pulse width TM is sufficiently large, including a margin of safety, and the rotor is angularly moved through 180 degrees to thereby assure normal movement of the hands. One of the two processes described above is repeated each time for successfully driving the step motor.

Whereas in the illustrated embodiment of FIG. 10, the inverter 44 is used as the detecting element, a comparator may be used for detection purposes, or alternatively, a threshold potential of a Schmitt trigger circuit may be utilized for positional determination. Whereas in FIG. 10 the circuit is constructed to detect a potential at the point Z at one end of the single resistor 41, two detection resistors 60, 61 connected to the ends of coil may be used as shown in FIG. 12. With such a modified construction, the potential at a terminal 01 (or 02) of the coil 62 is detected. Further, although in the foregoing description a single stabilizing pulse is used in each stabilizing process, a plurality of stabilizing pulses 64, 65 may be applied as shown in FIG. 13, a method which is as advantageous and within the scope of the present invention.

In the analog electronic timepiece as described above in accordance with the invention, a stabilizing pulse is applied to bring the rotor into a stationary stable position after the drive pulse has been applied. Thus, an intermediate stop which is responsible for lagging of the hands is eliminated and absolutely reliable hand movement is assured. Because the width of the stabilizing pulse which is applied may be very small, substantially no increase in the overall current consumed results from application of the stabilizing pulse. The construction of the invention is applicable to analog electronic timepieces without incurring additional cost. Hence, it is highly practical in application.

Figure 14:
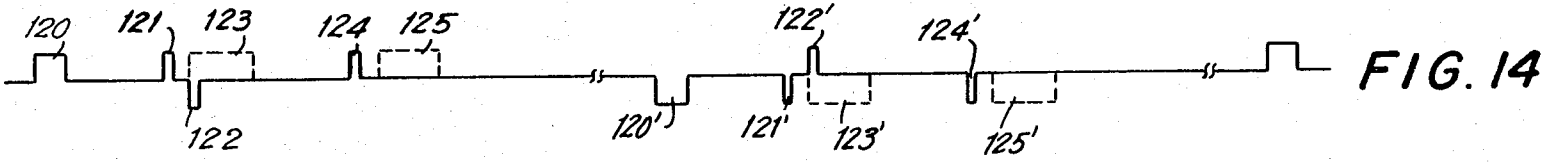
FIG. 14 is another alternative waveform of a signal applied to the stepper motor of FIG. 1 in accordance with the invention.

In an alternative embodiment of an analog electronic timepiece in accordance with the invention, pulses, having the waveforms of FIG. 14, are applied to the coil. A drive pulse 120 is selected from several pulses with different pulse widths so as to be optimum for the condition in which the array of wheels is loaded and for the output torque condition of the motor. Also applied are a first detection pulse 121 and a first correction pulse 123 (broken lines) which is applied when it is determined by the first detection pulse 121 that the rotor has not been rotated by the drive pulse 120. A second detection pulse 124 and a one second correction pulse 125 may be also be applied. The second correction pulse is applied when it is determined by the second detection pulse that the rotor again has not been rotated.

A pulse 122, which is an important feature of the present invention, serves to displace the rotor into a stationary stabilized position when the rotor has been brought to an intermediate stop position as described above. This pulse 122 is hereinafter referred to as a stabilizing pulse. The stabilizing pulse 122 is applied when the rotor is sensed to have been rotated as a result of the first detection pulse, even though the motor has only achieved the intermediate stop position.

Figure 15:
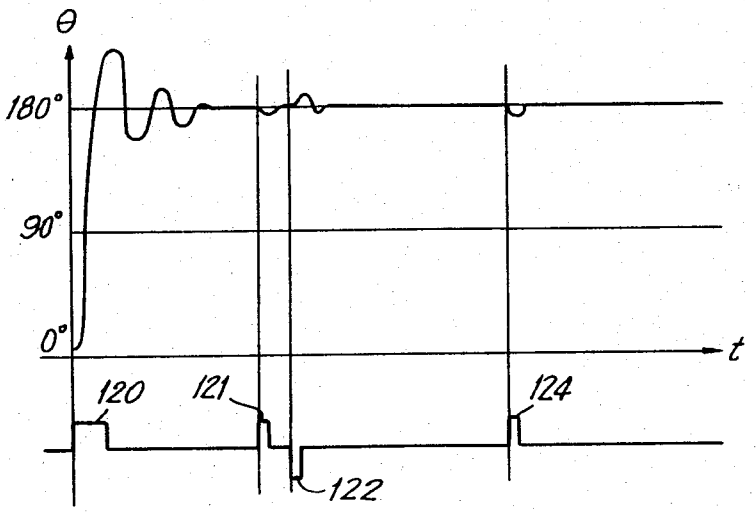
FIGS. 15, 16 and 17 are graphical representations showing angular displacement of the stepper motor waveform in response to the applied voltage signals.

When the drive pulse 120 is large enough to rotate the rotor, that is, of sufficient pulse width, the rotor moves angularly through 180 degrees as shown in FIG. 15 to enable the hands of the timepiece to move normally. The ordinate $\theta$ is the angular displacement of the center of the magnetic poles of the rotor from a stationary stable position as in FIG. 1. The rotor is in a stationary stable position when $\theta=180°$ and in another stable position when $\theta=0°$. The rotor is in a neutral position which is desirably avoided when $\theta=90°$. In FIG. 15, because the rotor is found by the first detection pulse 121 to have been rotated, a correction pulse 123 is not applied, but the stabilizing pulse 122 and the second detection pulse 124 are applied. As illustrated in FIG. 15, these pulses 121, 122, 124 produce slight motions of the rotor but the rotor always returns to the stable position at 180°.

Figure 16:
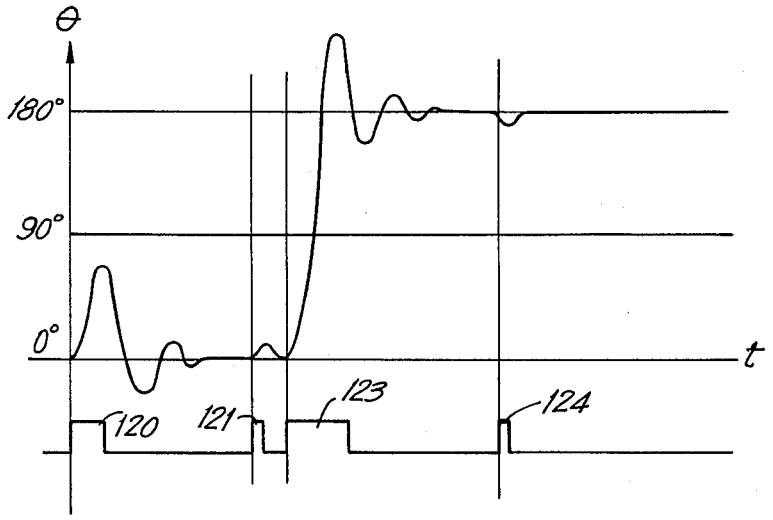

FIG. 16 illustrates the condition in which the drive pulse 120 is insufficient to rotate the rotor, a condition different from that of FIG. 15. In FIG. 16, the rotor is found by the detection pulse 121 to be in its original, that is, non-rotated position. Then, the wide correction pulse 123 is applied to angularly move the rotor through 180° for proper movement of the hands of the timepiece.

Figure 17:
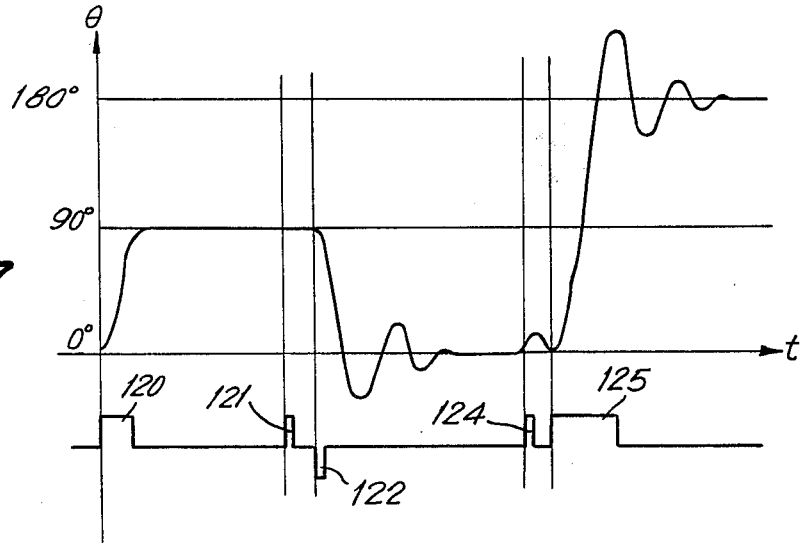

FIG. 17 is illustrative of the situation wherein an output torque generated by the drive pulse 120 and the load torque are in equilibrium or in a state of balance. The rotor is brought to an intermediate stop at the neutral point with $\theta=90°$. When the rotor is brought to such an intermediate stop, the hands of the timepiece lag in movement. In accordance with the invention, the above shortcoming is resolved by applying the stabilizing pulse 122 after the first detection pulse 121 has been applied. Thus, even when the rotor remains at the neutral point with $\theta=90°$ after the detection pulse has been applied, the stabilizing pulse 122, when applied, causes the rotor to return to the stationary stabilized position with $\theta=0°$. When the rotor is caused by the stabilizing pulse 122 to return to the position with $\theta=0°$, the rotor is sensed by the second detection pulse 124 to be in a non-rotated position. Then, the second correction pulse 125 is applied to the coil. The second correction pulse 125 is of such width as to produce sufficient motor torque enabling the rotor to rotate, without failure, to the position where $\theta=180°$. Thus, proper movement of the hands is insured. With the present invention, the stabilizing pulse applied after the first detection pulse has been applied solves the problem which would otherwise cause the timepiece to lose even-numbered seconds. As a result there is absolute assurance of reliable movement of the hands.

The stabilizing pulse can be applied in the same direction as that of the drive pulse, or in a direction opposite to that of the drive pulse as in the operations of FIGS. 15, 17. Experiments have confirmed that the best results are obtained when the stabilizing pulse is applied in a direction opposite to that of the drive pulse in accordance with this embodiment (FIG. 14–22). It has been confirmed that the rotor can be returned to a stationary stabilized position in response to application of a stabilizing pulse having a small pulse width. The reasons for such returning movement of the rotor are considered to be as follows. When the rotor is brought to an intermediate stop position, the array of wheels will be subjected to a smaller load upon return motion of the rotor than upon further rotation of the rotor. Additionally, magnetic potential curves are asymmetrical for the direction to further rotate and return the rotor. At any rate, the intermediate stop can effectively be corrected when the stabilizing pulse is applied in a direction opposite to that of the drive pulse as in FIGS. 15–17.

Figure 18:
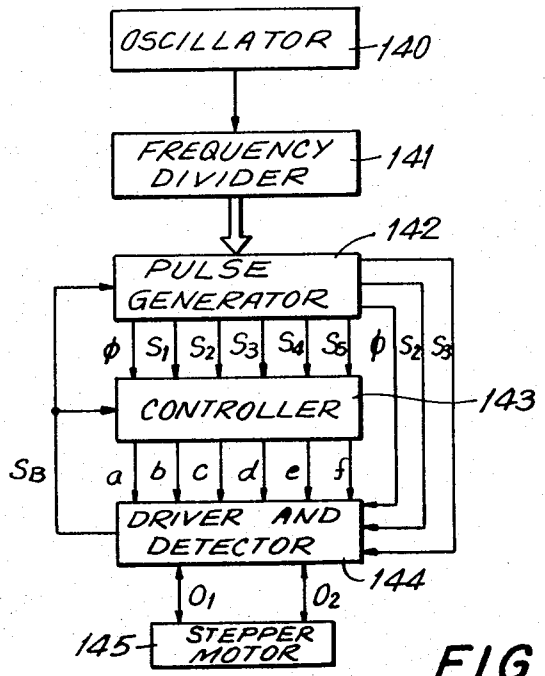
FIG. 18 is a functional block diagram of a circuit for an electronic analog timepiece in accordance with the invention.

A particular circuit arrangement for an analog electronic timepiece in accordance with the invention is now described with reference to the block diagram of FIG. 18. The circuit comprises an oscillator 140, frequency divider 141, pulse generator 142, controller 143, driver and detector 144 and stepper motor 145. The oscillator 140 serves to generate a time standard signal having a frequency of 32,768 Hz in response to oscillation of a quartz crystal vibrator. The frequency divider divides the time standard signal from the oscillator 140 down to a signal of ½ Hz. The pulse generator 142 generates pulses $\phi$, S1, S2, S3, S4, S5, the waveforms of which are shown in the time charts of FIGS. 21, 22.

Although the oscillator 140, frequency divider 141, and pulse generator 142 are indispensible components for an analog electronic timepiece in accordance with the invention, they are not novel portions of the present invention and accordingly are not described in further detail herein. These components can readily be constructed by one skilled in the art using logic elements.

Figure 19:
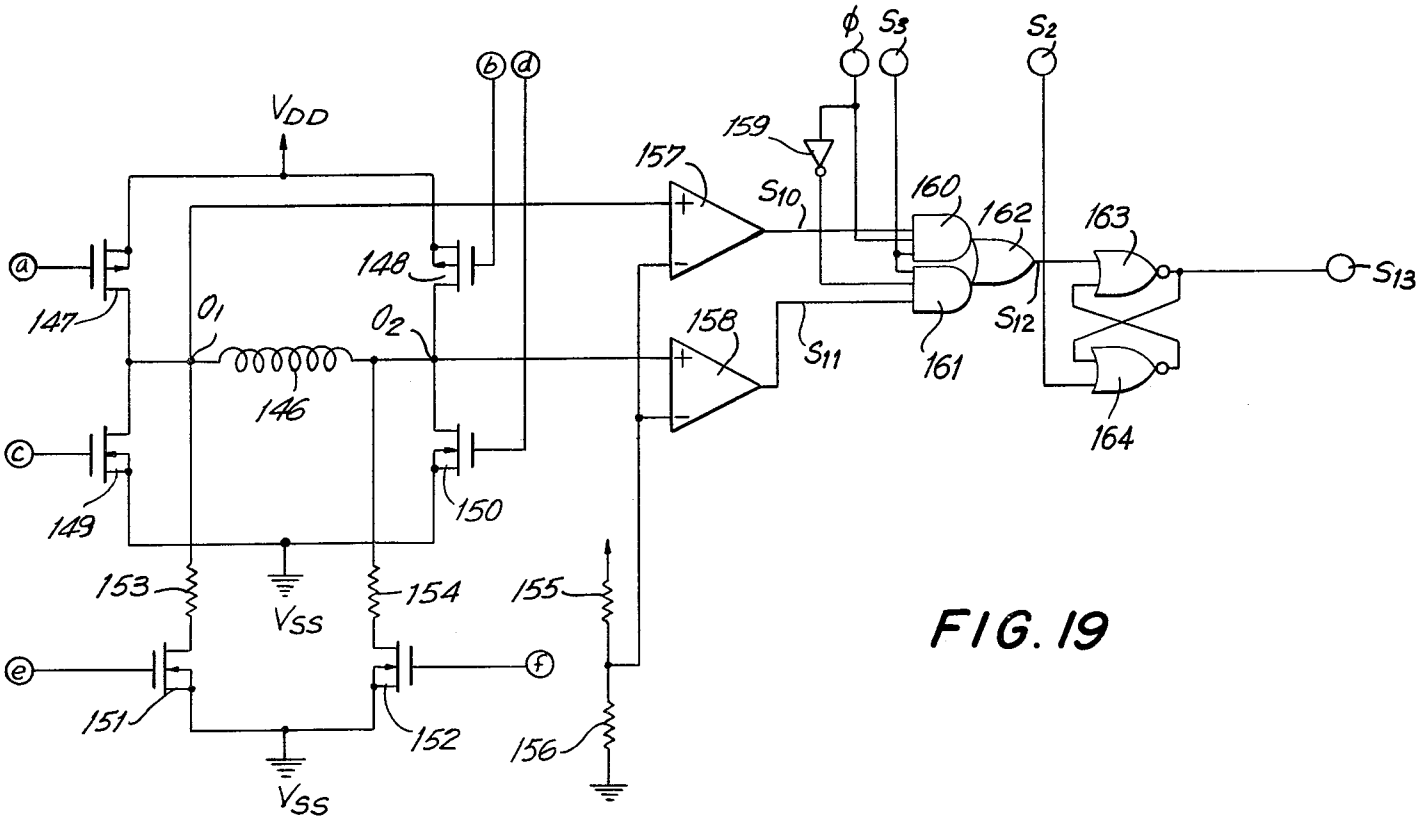
FIG. 19 is a circuit diagram of a driver and detector of FIG. 18 in accordance with the invention.
Figure 20:
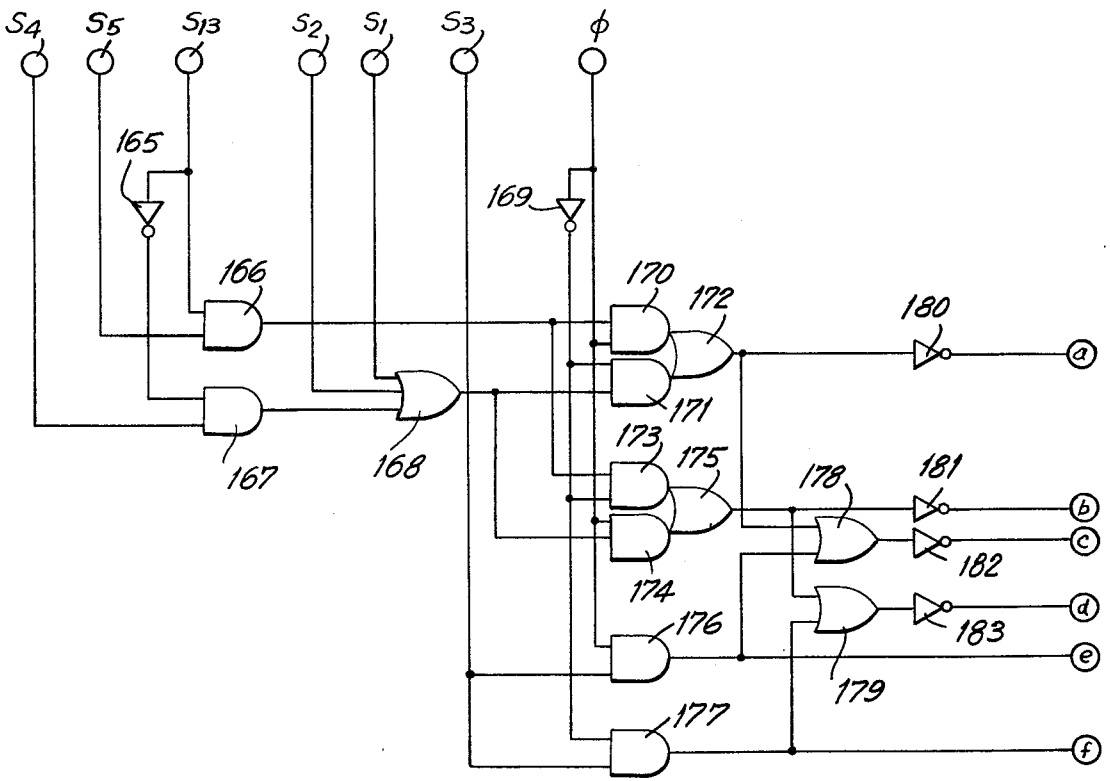
FIG. 20 is a circuit of a controller of the circuit of FIG. 18 in accordance with the invention.
Figure 21:
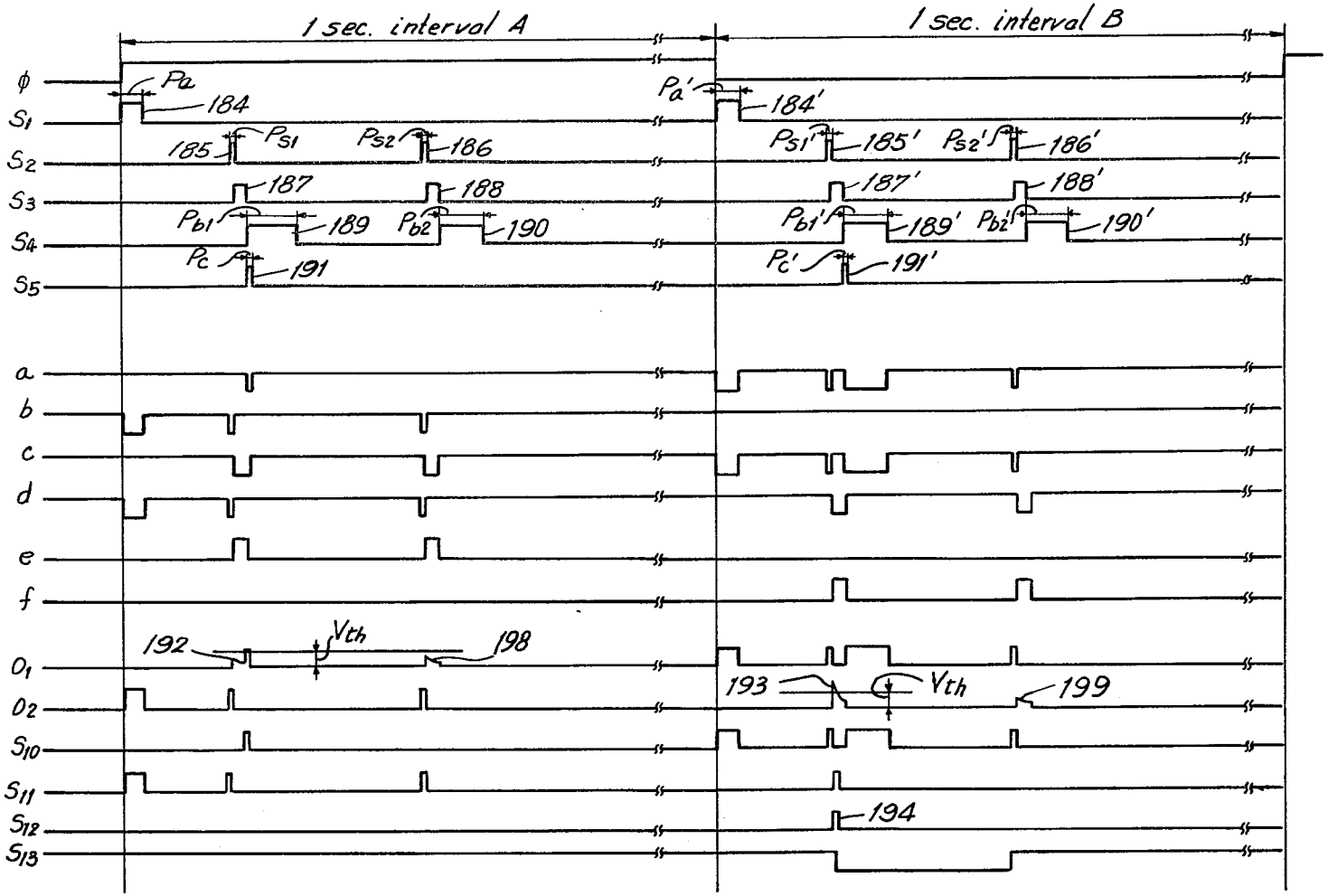
FIGS. 21 and 22 are timing waveforms for signals applied to the circuits of FIGS. 19 and 20.
Figure 22:
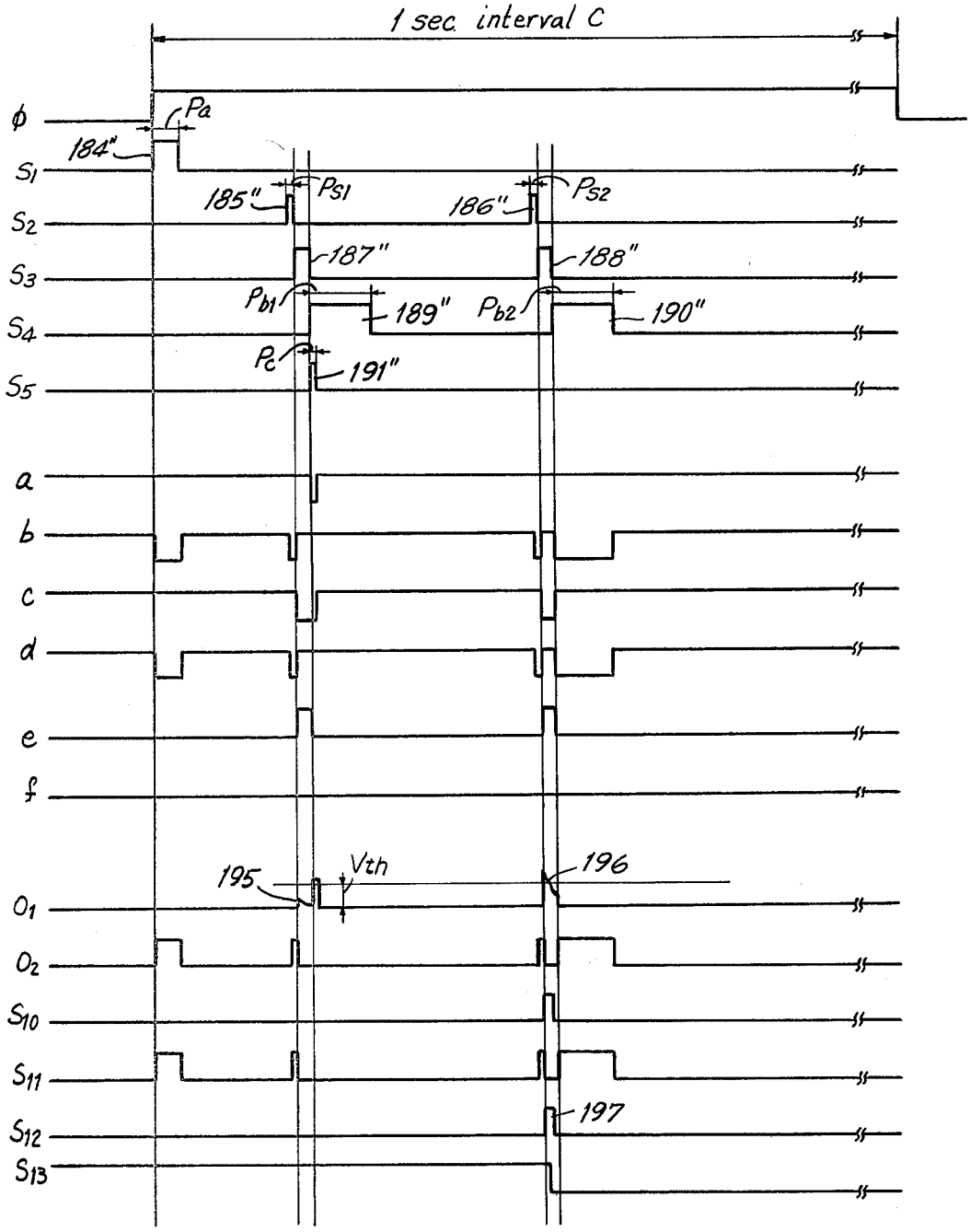

FIG. 19 is illustrative of a circuit construction for the driver and detector 144. FIG. 20 is a circuit construction for the controller 143, and FIGS. 21 and 22 are timing charts of signals in the controller 143 and the driver and detector 144. In FIG. 21, $\phi$, S1 are ½ Hz signal and a signal for determining the width of a drive pulse respectively. The signal S1 includes an interval 184 of high logic level (H) which determines the width Pa of the drive pulse. Pa is controlled in width by a signal S13 having information as to rotation or non-rotation of the motor as illustrated in FIG. 18. The drive pulse Pa has a pulse width corresponding to the load imposed on the motor.

The signal S2 serves to determine the timing for issuing the detection pulse and the width of the detection pulse. The signal S2 has high intervals 185, 186 which determine the timings at which the detection pulses Ps1, Ps2 are to be applied and the widths of such pulses. Ps1, Ps2 denote first and second detection pulses respectively.

The signal S3 serves to determine the intervals in which detection is carried out, and includes detection intervals 187, 188. The signal S4 determines timing for the correction pulses and has intervals 189, 190 of high level for establishing the timings at which the first and second correction pulses Pb1, Pb2 are generated and applied, and the widths of such correction pulses. The signal S5 serves to determine timing for a stabilizing pulse for preventing the rotor from being brought to an intermediate stop and has a high level interval 191 for determining duration Pc of the stabilizing pulse. The foregoing signals are supplied from the pulse generator 142 to the controller 143 (FIG. 18).

The driver and detector 144 is shown in FIG. 19 and comprises P-channel transistors 147, 148 and N-channel transistors 149, 150 which jointly constitute the driver for a stepper motor 146, which is represented schematically by the motor coil. N-channel transistors 151, 152 serve to switch detection resistors 153, 154 for current flow. The transistors have gate terminals a–f which are supplied respectively with the signals a–f illustrated in FIGS. 21, 22. Comparators 157, 158 produce an output which is high when the potential at 01 or 02 respectively is larger than a reference potential Vth produced at an intermediate point of a voltage divider comprised of resistors 155, 156 in series. The comparators 157, 158, produce a low output when the potential 01 or 02 respectively is less than the reference voltage Vth. The comparators 157, 158 produce output signals S10, S11, respectively which are inputted to AND gates 160, 161, the outputs of which are connected to inputs of an OR gate 162. The AND gate 160, 161 and the OR gate 162 open during a detection interval in which the signal S3 is in the high logic level state. The OR gate 162 delivers data from the terminal 01 when the signal $\phi$ is high and data from the terminal 02 when the signal $\phi$ is low. The output from the OR gate 162 constitutes a signal S12 that serves as a setting signal for a set-reset type flip-flop composed of NOR gates 163, 164. The flip-flop is inputted with a reset signal which is the signal S2 for determining a detection signal. The flip-flop produces an output signal S13 which is fed back to the pulse generator and the controller as shown in FIG. 18.

FIG. 20 shows the controller 143 which serves to process the signals $\phi$, S1, S2, S3, S4, S5 generated by the pulse generator 142 and the signal S13 fed back from the driver detector 144 to produce the signals a–f which are supplied to the gate terminals of the driver and detector illustrated in FIG. 19.

Operation of the driver and detector of FIG. 19 and the controller of FIG. 20 is now described with reference to the timing chart illustrated in FIG. 21. Operation during a one-second interval A is first described. During the interval A, the rotor is rotated by the drive pulse Pa and the rotor is determined to have been rotated by the first and second detection pulses. In FIG. 20, the OR gate 168 produces an output which is high when the interval 184, determining the pulse Pa, enters from the input S1. Since the signal $\phi$ is high at this time, an AND gate 174 opens and an OR gate 175 produces an output which is high. The signal from the OR gate 175 is inverted by a NOT gate 181, so that the signal b goes low. The output from the OR gate 175 also delivered through an OR gate 179 and a NOT gate 183 to render the signal d low. With the signals S3, S4 and S5 all being low, the signals a, c go high, and the signals e, f go low. In FIG. 19, the P-channel transistors 147, 148 are turned off and on respectively, and the N-channel transistors 149, 150 are turned on and off, respectively. Thereupon, a current flows through the coil 146 from the point 02 to the point 01.

Subsequent to the pulse Pa, the first detection pulse Ps1 (185) of the signal S2 is issued. During the interval subsequent to the pulse Pa and prior to the pulse Ps1, the signal S1–S5 are all low, and accordingly, the signals a–d are all high with the terminals 01, 02 of the coil 146 remaining low.

When the first detection pulse Ps1 is outputted as at 185 of the signal, the signals a, b, c, and d go high, low, high, and low respectively as with application of the pulse Pa of the signal S1 so that a detection current flows within the coil 146. When the pulse 187 of the signal S3 for determining a detection interval is applied, an AND gate 176 produces a high output and the signals e, c go high and low respectively. The detection current which flows from the coil 146 now flows through the detection resistor 153 and a signal having a waveform 192 as shown in FIG. 21 appears at the terminal 01.

The peak value of the signal 192 is small since the rotor has rotated in response to application of the pulse Pa. The peak of the signal 192 is less than the potential Vth, so that the output of the comparator 157 (FIG. 19) goes low, and the flip-flop 163, 164 is not set and its output S13 remains high. With the signal S13 being high, an AND gate 166 (FIG. 20) opens to deliver the stabilizing pulse from the terminal S5. An AND gate 167 closes to block the first correction pulse from the terminal S4. When the second detection pulse 186, the second detection interval 188, and the second correction pulse 190 (FIG. 21) occur, the rotor has already been rotated. Thus, the detection voltage 198 at the terminal 01 again does not exceed the voltage Vth. The signal S13 remains high and the second correction pulse Pb2 (190) is not outputted.

Operation during an interval B of FIG. 21 is now described. The interval is indicative of the timing charts for operation in which a drive pulse Pa' is insufficient to rotate the rotor and the rotor is determined by a first detection pulse as not having been rotated. Then a correction pulse Pb1 is produced. With the rotor in the non-rotated state, the first detection pulse Ps1' produces a detection voltage 193 at the terminal 02 of the coil 146, the detection voltage 193 having a peak value greater than the voltage Vth. The output signal S12 from the OR gate 162 (FIG. 19) goes high as illustrated at 194 and the signal S13 goes low. When the signal S13 is latched in the low level, a stabilizing pulse Pc' (191') is not produced at S5 and a first correction pulse Pb1' (198) is outputted, so that the rotor is angularly moved through 180° and produces proper movement of the hands.

Since the rotor rotates without failure upon generation of the first correction pulse Pb1', a detection voltage produced by a second detection pulse Ps2' (186') does not exceed the voltage Vth as shown at 199. The flip-flop composed of the NOR gates 163, 164 (FIG. 19) remains set and the signal S13 remains high with the result that no second hand-correction pulse is produced.

FIG. 22 is a timing chart for signals in a circuit construction of FIGS. 19, 20, the timing chart being similar to that of FIG. 21. During interval C, the rotor is brought to an intermediate stop by the drive pulse Pa (184"). The rotor is sensed by the first detection pulse Ps1 (185") as having been rotated, with the result that the signal S13 remains high. The first correction pulse Pb1 (189") is not outputted to the coil 146, and the stabilizing pulse Pc (191") is outputted instead. The rotor is returned to the stationary stabilized position by the stabilizing pulse Pc (191") and the second detection pulse Ps2 (186") is outputted to generate a detection voltage 196 exceeding the voltage Vth at the terminal 01, whereupon the signal S13 goes low. Therefore, the second correction pulse Pb2 (190") is generated to angularly move the rotor through 180° for proper hand movement.

In accordance with the invention, the first and second detection and stabilizing pulses are outputted during normal operation, resulting in an increase in current consumption. Assuming that the first and second detection pulses have a pulse width of 0.36 milliseconds and the stabilizing pulse has a pulse width of 0.24 milliseconds, experiments have indicated that average current consumed by the first and second detection pulses are each 14nA, and the average current consumed by the stabilizing pulse is 10nA. The result is a total current consumption of 38nA which is very small. Such a small current increase due to these pulses does not adversely affect the overall service life of the battery for the timepiece.

With the construction of the present invention as described above with reference to FIGS. 14–22, the stabilizing pulse is applied in a direction opposite to that of the drive pulse after the first detection pulse indicating rotation has been outputted. Thereby, the rotor is prevented from having an intermediate stop which would cause the hands to lag in operation. Thus, absolutely reliable movement of the hands is ensured when using a minimum initial driving pulse Pa. Since the pulse width of the stabilizing pulse is very small, no substantial increase in current consumption results from application of the stabilizing pulse.

In an analog electronic timepiece in accordance with the invention, nothing is introduced in the construction which leads to an increase in the cost of manufacture. The invention is applicable to analog electronic timepieces simply by changing logic elments in integrated circuits and is highly practical in application.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An analog timepiece, comprising:

oscillator means for generating a periodic time standard signal;

frequency divider means for receiving and dividing the periodic time standard signal;

stepper motor means comprising rotor means, stator means and coil means, said rotor means being rotatable;

driving and control means for applying a drive signal to said stepper motor means, said driving and control means applying a drive signal to said stepper motor means that includes a first drive pulse for rotating said rotor, a second stabilizing pulse for stabilizing said rotor to affect a positioning of the rotor in one of a rotated and non-rotated position, and a third detection pulse, and detection means for detecting the positioning of said rotor in one of said rotated and non-rotated positions in response to said detection pulse, said detection means applying a non-rotation signal to said driving and control means in response to the detection of the rotor being in the non-rotated state, said driving and control means applying a fourth drive pulse to the stepper motor in response to said non-rotation signal, said fourth drive pulse affecting rotation of said rotor to said rotated position.

2. The timepiece of claim 1 wherein the stabilizing pulse is applied in the same direction as said first drive pulse.

3. The timepiece of claim 1 wherein the stabilizing pulse is applied in a direction opposite to the direction of said first drive pulse.

4. The timepiece of claim 1 wherein the fourth drive pulse is applied in the same direction as said first drive pulse and is of a duration which is longer than the duration of said drive pulse.

5. The timepiece of claim 1 wherein the rotor is a permanent magnet, the stator is an integral, belt-like plate having a hole for positioning the rotor and at least one notch for determining reference positions of the rotor and the coil is a driving coil.

6. The timepiece of claim 5 wherein the stator has a first notch and a second notch.

7. The timpiece of claim 5 wherein the permanent magnetic rotor has a first polarity and a second polarity.

8. The timepiece of claim 1 wherein the detection pulse follows the stabilizing pulse by a delay period sufficient to allow attenuation of the transitional oscillation of the rotor caused by application of the stabilizing pulse to the stepper motor means.

9. The timepiece of claim 1 wherein the detector means comprises a first switching element for a driving circuit and a second switching element for operating a detection resistor connected to the coil.

10. The timepiece of claim 1 wherein the detection means detects the quantity of induced voltage generated in the coil means as a result of the application of the detection pulse.

11. An analog timepiece, comprising:

oscillator means for generating a periodic time standard signal;

frequency divider means for receiving and dividing the periodic time standard signal;

stepper motor means comprising rotor means, stator means and coil means, said rotor means being rotatable;

detector means for detecting whether the rotor is in a rotated or a non-rotated position;

driving and control means for applying a drive signal to said stepper motor means, said driving and control means applying a drive signal to said stepper motor means that includes a first drive pulse for rotating said rotor, a second detection pulse, said detection means detecting the positioning of said rotor in one of said rotated and non-rotated positions in response to said detection pulse, a third stabilizing pulse for stabilizing said rotor to affect a positioning of the rotor in one of said rotated and said non-rotated positions, and a fourth detection pulse, said detection means detecting the positioning of said rotor in one of said rotated and said non-rotated states in response to said detection pulse.

12. The timepiece of claim 11 wherein the driving control means applies a second drive pulse to rotate the rotor, when the detector means detects that the rotor is in the non-rotated position.

13. The timepiece of claim 12 wherein the second drive pulse is of longer duration than the first drive pulse.

14. The timepiece of claim 11 further including pulse control means for controlling the duration of the first drive pulse in response to an output from the detector means.

15. The timepiece of claim 11 wherein the rotor is a permanent magnet, the stator is an integral belt-like plate having a hole in which the rotor fits and at least one notch for determining a reference position and the coil is a driving coil.

16. The timepiece of claim 15 wherein the permanent magnetic rotor has a first polarity and a second polarity.

17. The timepiece of claim 11 wherein the second detection pulse follows the stabilizing pulse by a delay period sufficient to allow attenuation of the transitional oscillation of the rotor, caused by application of the stabilizing pulse to the stepper motor means.

* * * * *